US006030299A

United States Patent [19]

Denny

[11] Patent Number: 6,030,299

[45] Date of Patent: Feb. 29, 2000

[54] BASEBALL TRAINING DEVICE

[76] Inventor: Michael S. Denny, 7905 Hwy. 39, Braithwaite, La. 70040

[21] Appl. No.: 08/920,183

[22] Filed: Aug. 25, 1997

[51] Int. Cl.[7] ..... A63B 69/00

[52] U.S. Cl. ..... 473/423; 473/423

[58] Field of Search ..... 473/423, 426, 473/429, 430, 436, 437, 506, 507, 508, 431, 108, 109, 160, 197, 213, 214; 273/329, 330, 331, 335, 317.8, 145, 149

[56] References Cited

U.S. PATENT DOCUMENTS

| | | | |
|---|---|---|---|
| 3,271,030 | 9/1966 | Mueller | 473/423 |
| 3,408,070 | 10/1968 | Gonzales et al. | 273/26 |
| 3,999,753 | 12/1976 | Desilets et al. | 273/29 |
| 5,029,852 | 7/1991 | Gilfillan | 473/417 |
| 5,035,424 | 7/1991 | Liao | 273/26 |
| 5,060,946 | 10/1991 | Taylor | 273/411 |
| 5,203,558 | 4/1993 | An | 473/423 |
| 5,303,914 | 4/1994 | Cooksey | 473/423 |
| 5,374,056 | 12/1994 | Scher et al. | 473/417 |
| 5,415,396 | 5/1995 | Huang | 473/417 |
| 5,427,369 | 6/1995 | Baquet | 473/429 |
| 5,467,979 | 11/1995 | Zarate | 273/26 |
| 5,472,186 | 12/1995 | Paulsen | 273/26 |
| 5,494,278 | 2/1996 | Linden | 273/26 |
| 5,601,286 | 2/1997 | Fierbaugh | 473/429 |
| 5,618,039 | 4/1997 | Tsai et al. | 473/423 |

*Primary Examiner*—Theatrice Brown
*Attorney, Agent, or Firm*—Keaty & Keaty

[57] ABSTRACT

The invention relates to a baseball teaching device that allows to develop striking skills of a player by emulating a force with which a ball travels before being hit by a player. The device has a frame mountable on a horizontal surface, an upright pole extending from the base and a baseball support arm extending traversely to the pole when the device is in use. The baseball support member is a flexible resilient plate that offers the necessary resistance to a striking force exerted by the player when the baseball is hit by a bat. An optional resilient insert is embedded into the body of the plate to increase resistance to the striking force by making the plate less flexible.

9 Claims, 5 Drawing Sheets

BASEBALL TRAINING DEVICE

BACKGROUND OF THE INVENTION

The present invention relates to a sport training equipment, and more particularly to a baseball training device adopted for teaching players correct striking force and movement.

It is a common knowledge that one of the most important skills for a baseball player is an eye and hand coordination and the ability to strike a ball at a precise place, so called "soft spot", to carry the ball to a desired distance. Various teaching devices have been known for training beginner players, some of the teaching tools including a vertically mounted upright standard with a ball tethered to the standard on either a solid support arm or a flexible tether string.

The devices that utilize a rigid support arm hold a baseball in a fixed position, allowing the arm to rotate about the standard following a strike by a player. The devices that use a tether line allow the ball to freely spin about the standard and come to rest under gravity. The ball in a flexible tether system is usually suspended from a horizontal arm extending from the upright standard and offers virtually no resistance to a striking force exerted by the player. Such systems do not allow a player to develop the necessary skills to apply just the correct amount of force to strike the ball. As a result, it is difficult to teach the player the correct amount of force that needs to be applied to hit a ball that moves at a considerable speed toward the player.

The present invention contemplates elimination of drawbacks associated with the prior art and provision of a baseball teaching device which teaches hand and eye coordination to beginner players, with particular emphasis on developing skills that would allow a player to exert the necessary amount of force for striking a ball.

SUMMARY OF THE INVENTION

It is therefore an object of the present invention to provide a baseball teaching apparatus for use during training sessions for developing striking skills of baseball players.

It is another object of the present invention to provide a baseball teaching apparatus, where position of the ball can be adjusted along a vertical plane.

It is a the further object of the present invention to provide a baseball teaching apparatus that can be easily disassembled for transportation and reassembled for practice at a desired location.

It is still a further object of the present invention to provide a baseball teaching apparatus that can serve as a support for a baseball bat between training sessions.

These and other objects of the invention are achieved through a provision of a baseball teaching apparatus which comprises a base mountable on a horizontal surface adjacent a home plate. The base supports an upright pole which is detachably secured to the base and extends vertically upwardly therefrom when the apparatus is in use. A resilient baseball support arm has a proximate end adapted for mounting on the pole and a distal end having an opening within which a standard size baseball is secured. The baseball support arm is formed from a resilient flexible material allowing the arm to bend in response to a striking force exerted on the ball when hit by a baseball bat. If desired, the resistance of the resilient member can be increased by inserting a thin spring plate in the body of the resilient member, to thereby approximate as closely as possible conditions of a baseball traveling at a certain speed after being thrown by a player.

The baseball support arm is nonrotatably mounted on the pole with the help of a hollow sleeve that slides over the pole and is secured in a desired location by inserting a pin through an aperture formed in the sleeve and one of the openings formed in the body of the pole. A baseball bat support arm is secured to the opposite side of the sleeve to allow storage of a baseball bat when the apparatus is not in use.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
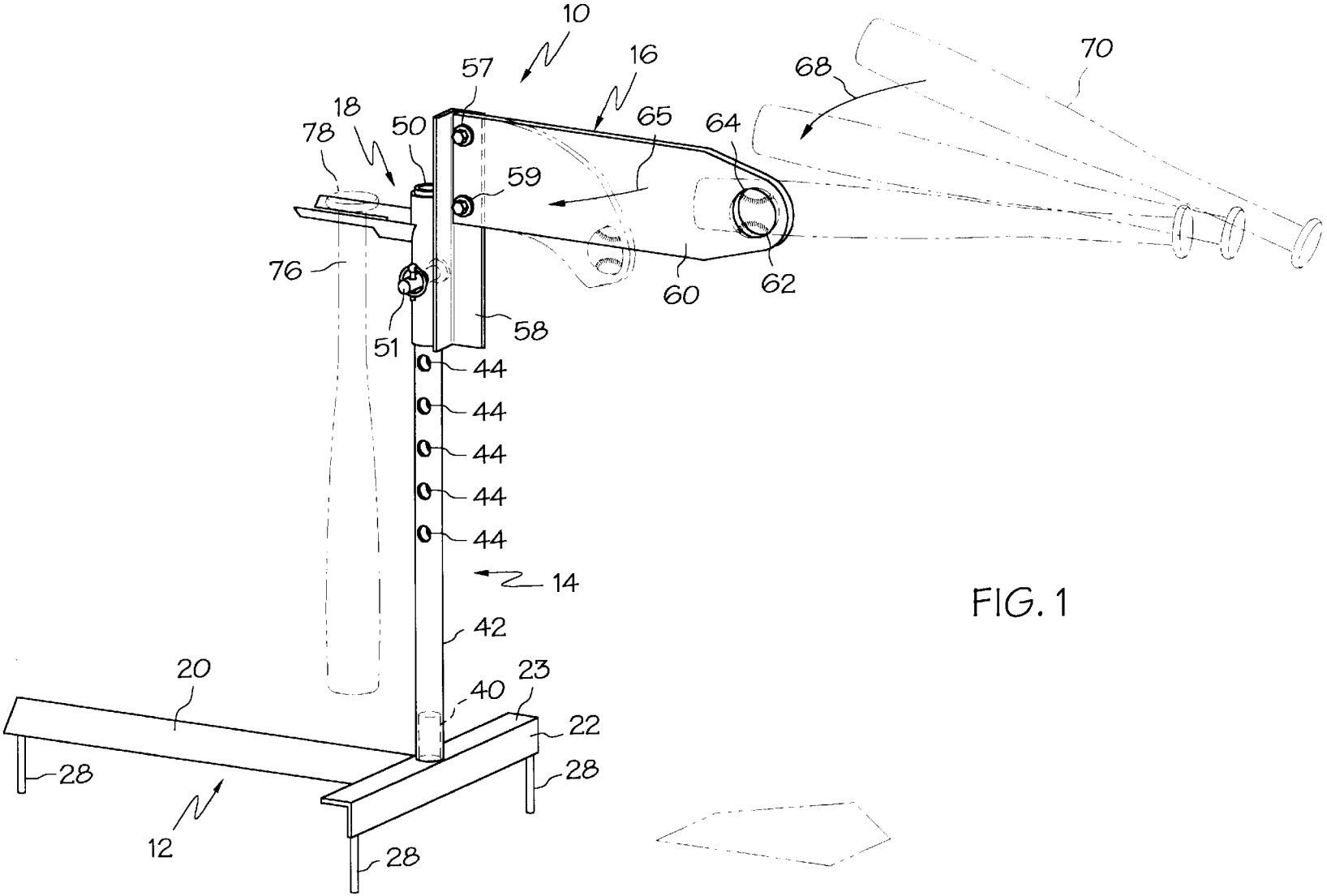
FIG. 1 is a perspective view of the baseball teaching apparatus in accordance with the present invention.
Figure 3:
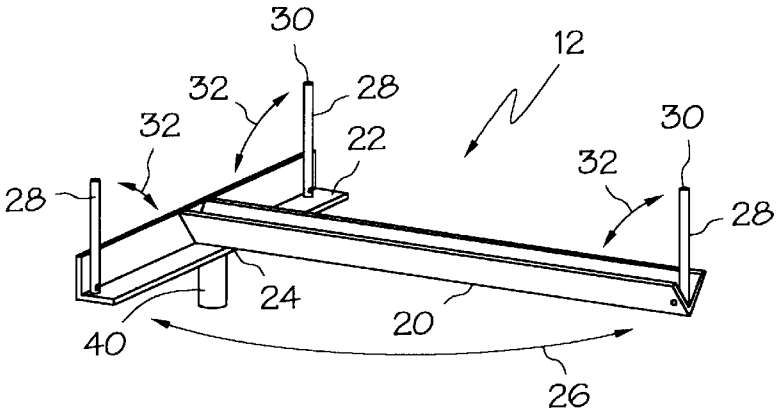
FIG. 3 is a bottom view of the base showing hinged spikes.
Figure 2:
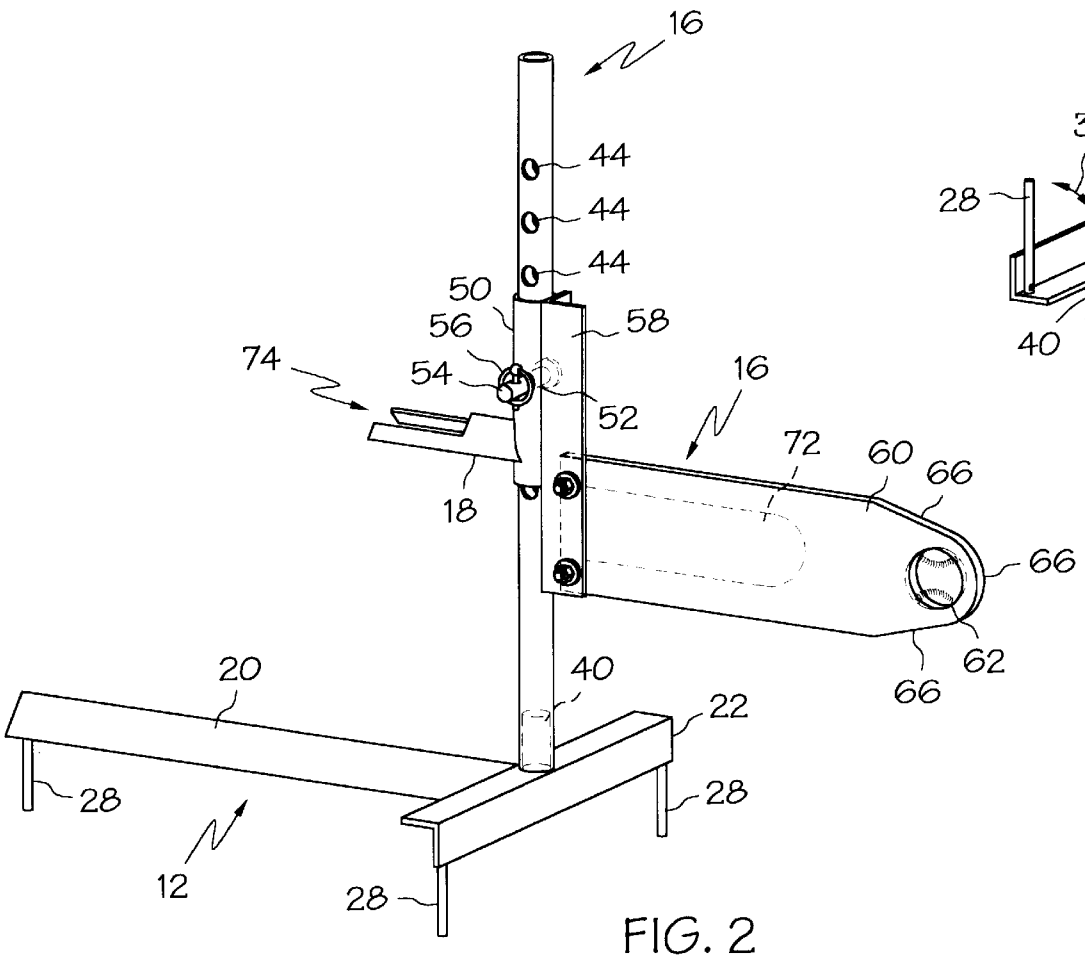
FIG. 2 is a perspective view of the baseball training apparatus of the present invention, with the support arm moved to an alternative reverse position.

Referring now to the drawings in more detail, numeral 10 designates the baseball training apparatus in accordance with the present invention with reference to FIGS. 1–3, the apparatus 10 comprises a base 12, an upright pole 14, a baseball support arm 16 and a bat holder 18. The base 12 comprises a T-member with an elongated bar 20 secured to a cross bar 22 at an approximately midpoint thereof. The elongated bar 20 and the cross bar 22 can be formed from an angle iron, as shown in FIG. 3, or other suitable rigid material which is lightweight enough to allow transportation of the apparatus 10 in a folded condition. The elongated bar 20 is hingedly attached, such as at 24 to the cross bar 22 and can move in the direction of arrow 26 when being folded.

Extending downwardly from the bottom surfaces of the bars 20 and 22 are embedment spikes 28 which are adapted for insertion into the soil at a location where the apparatus 10 is to be mounted. The spikes 28 have sharpened points 30 to facilitate driving of the spikes 28 into the soil. The spikes 28 are hingedly attached to the respective bars 20 and 22 and can be folded in the direction of arrows 32 for storage or transportation of the apparatus 10.

Extending upwardly from a top surface of the cross bar 22 is a pole securing pin 40 that can be circular or rectangular in cross-section, selected to correspond to an interior opening formed in the bottom of the pole 14. As can be seen in FIGS. 1 and 2, the pin 40 fits into the lower portion 42 of the pole 14, allowing the pole 14 to extend in a vertical orientation while telescopically engaging the pin 40. While in the preferred embodiment the pole 14 is not rigidly attached to the base 12, it is possible to weld the pole 14 to the pin 40 if a permanent installation is desired.

A plurality of openings 44 are formed through the body of the pole 14, the openings 44 extending on diametrically opposite sides of the pole 14, if the pole is made from a tubular member, or on opposite sides of the pole 14 if the pole has a rectangular cross-section.

Figure 6:
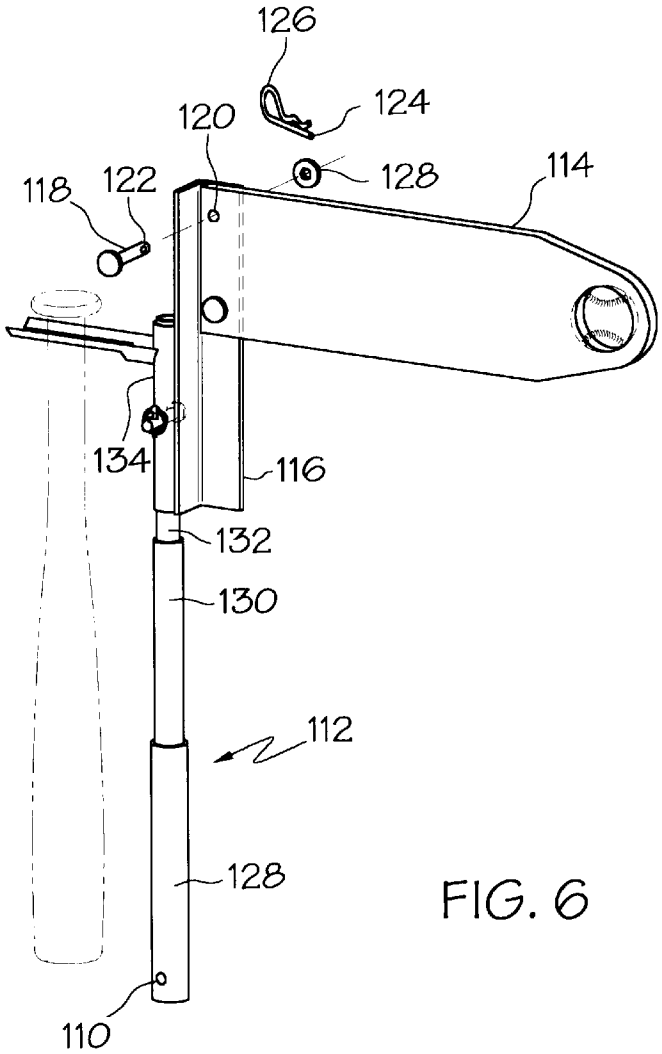
FIG. 6 is a detail view showing an alternative manner of attachment of a baseball support arm.
Figure 14:
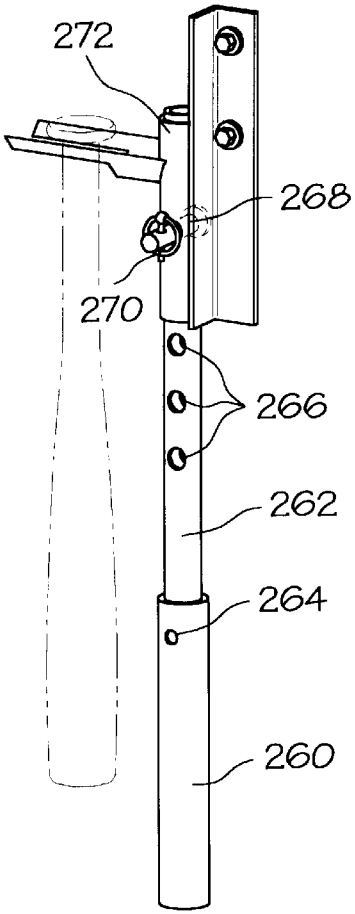
FIG. 14 is a detail view illustrating an alternative embodiment of the upright pole with telescoping sections.

The openings 44 are large enough to receive a bolt or screw therethrough, with opposite ends of the bolt extending outwardly from the openings 44 and carrying a nut or a nut and washer assembly. The openings 44 are formed along the major part of the vertical length of the pole 14 to allow vertical adjustment of the baseball support arm 16 in relation to the pole. Alternatively, the pole 14 can be formed from two or more telescopically extending sections, as shown in FIGS. 6 and 14, each section containing one or more openings 44 and allowing extension of the pole 14 to a desired length, as well as repositioning of the baseball support arm 16 in relation to the extended sections of the pole.

The baseball support arm 16 comprises a sleeve 50 which is adapted for slidable movement along the length of the pole 14 to allow greater flexibility in the selection of the height where the support arm 16 is to be positioned. A pair of openings 52 are formed in the sleeve 50, the opening 52 corresponding to the dimensions of the openings 44 to receive a securing bolt, or pin 54 therein. The bolt 54 passes through the opening 52, then through the opening 44, and extends outwardly from the sleeve 50 on the opposite side of the sleeve 50. A washer, or nut and washer assembly 56 secures the bolt 54 in place, preventing the sleeve 50 from rotating about the pole 14.

Fixedly attached to one side of the sleeve 50 is a support bracket 58 that can be formed from an angle iron, as shown in FIG. 1, with one portion fixedly secured to the sleeve 50, and the second, perpendicularly extending portion carrying a flexible, resilient support plate 60. The flexible resilient support plate 60 is secured to the bracket 59 by one or more bolts or screws 57 extending through the body of the support plate 60 and the bracket 58. A suitable nut 59 prevents disengagement of each of the bolts 57 from the support plate 60 and the bracket 58.

The support plate 60 is formed from an elongated plate made of a flexible, resilient material, such as high density rubber, and the like. The plate 60 extends at a right angle to the pole 14 when the support member 16 is mounted on the pole 14. A baseball of standard size and weight, such a baseball 62 is mounted in an opening 64 formed at a distal end of the support plate 60.

The baseball 62 is secured to the support plate 60 by a plurality of screws, or bolts 66 extending through the thickness of the support plate 60 and extending into the baseball 62, so as to rigidly position the ball 62 within the opening 64. The screws 66 detachably hold the ball 62 in the support plate 60, allowing to change the ball 62, if it becomes worn, by removing the screws 66 and positioning another baseball within the opening 64.

The support plate 60 offers a considerable resistance to a striking force directed to the ball 62 in the direction of arrow 68, as shown in FIG. 1. It is preferred that the thickness of the plate 60 be sufficiently great to at least somewhat emulate the force with which the player has to strike the baseball 62 with a bat 70. In order to further enhance the striking skills of a player, a resilient flexible band 72 is inserted into the body of the plate 60, so as to make the plate 60 more resistant to bending under the striking force exerted on the ball 62 during a training session. The plate 60 bends in the direction of arrow 63 and assumes a position shown in phantom lines in FIG. 1 when a correct strike has been executed. The band 72 can be made from steel, or other similarly strong, resilient material that will force the band 72 and the support plate 60 back to their original position after the striking force has dissipated.

The bat support member 18 is mounted on the opposite side of the bracket 56 and is fixedly attached to the sleeve 50, such as by welding. The bat support bar 18 is provided with a slot 74 which is large enough to allow a handle portion 76 of the bat 70 to pass therein, while preventing the bat 70 (See FIG. 1) to slide to the ground. Instead, the slotted bar 18 supports the bat 70 due to a reduced size of the slot 74 in comparison to thickness of an end plate 78. When not in use, the bat 70 can be positioned on the bat support member 18 and be retained therein between the training sessions.

As can be seen in FIG. 2, the sleeve 50, being hollow in construction and having two open ends, can be reversed in its orientation in relation to the pole 14, such that the baseball support member 16 extends below the bottom opening 44 formed in the pole 14. In this manner, a greater flexibility for vertical adjustment of the support member 16 can be achieved.

Figure 4:
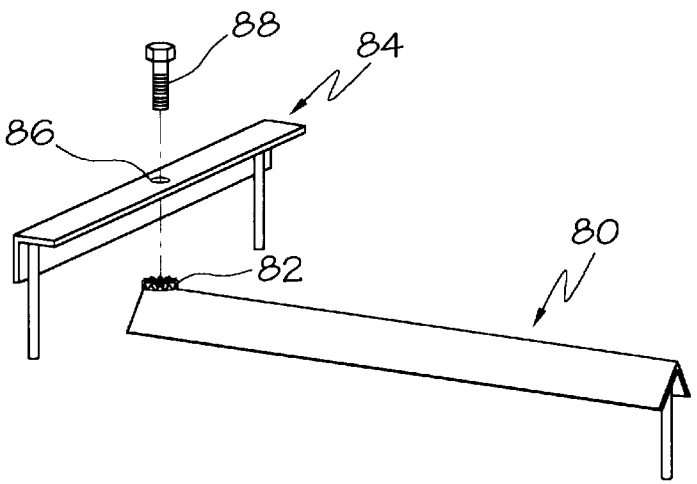
FIG. 4 is a detail view showing an alternative base structure using a bolted attachment.

Turning now to FIG. 4, an alternative manner of attachment of the base elements is illustrated. As can be seen in FIG. 4, an elongated bar 80 is provided with a plate 82 adjacent one of its ends. The plate 82 is provided with teeth separated by slots with a central opening in the plate 82 formed between the teeth. The plate 82 is fixedly attached to the elongated bar 80. A cross bar 84 is provided with an opening 86 in a center of the top plate thereof, the opening 86 being sized and shaped to receive a securing threaded bolt 88 therein. When the cross bar 84 is positioned in juxtaposition over the elongated bar 80, the bolt 88 is forced through the opening 86 and through a central opening formed in the plate 82, securing the cross bar 84 to the elongated bar 80. The teeth of the plate 82 prevent disengagement of the bolt 88 during operation of the device.

Figure 5:
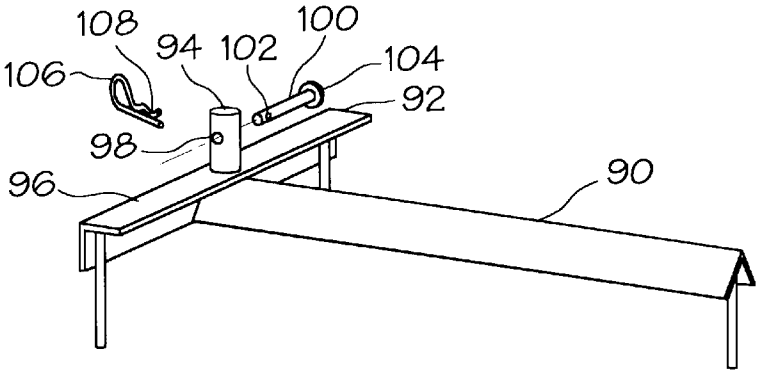
FIG. 5 is a detail view showing another alternative base structure using a clip and pin assembly for securing an upright pole.

FIG. 5 illustrates an alternative manner of securing a pole to the base. As shown in FIG. 5, an elongated bar 90 is secured to a cross bar 92, approximately midway between the opposite ends of the cross bar 92. A pole pin 94 is fixedly attached to a top plate 96 of the cross bar 92. The pin 94 is provided with a through opening 98 formed in a direction perpendicular to a longitudinal axis of the pole pin 94. The aperture 98 is sized to receive a pin 100 which, in turn, is formed with an opening 102 at an end opposite the head 104. A clip 106 is adapted to engage the pin 100 after it has been inserted into the opening 98, such that the aperture 102 appears on the opposite side of the pin 94 from the side where the head 104 is positioned. A hand 108 of the pin 106 is inserted into the opening 102, preventing disengagement of the pin 100 from the pole pin 94. The upright pole, in this embodiment, is provided with a through aperture 110 (FIG. 6) that is aligned with the opening 98 when the pole 112 is lowered onto the base. As a result, disengagement of the pole 112 from the base is prevented.

As further shown in FIG. 6, a similar attachment means can be employed for securing the baseball supporting arm 114 to the pole 112. In this embodiment, the support arm 114 is secured to the support bracket 116 by a pin 118 insertable into an opening 120 formed in the baseball support arm 114 and a co-aligned opening in the support bracket 116. An aperture 122 formed in the end of the pin 118 receives an arm 124 of a clip 126, securing position of the pin 118 in relation to the support arm 114 and the support bracket 116. A suitable washer 128 can be positioned on the pin 118 on the opposite side of the entry of the pin 118 into the opening 120.

FIG. 6 further illustrates an alternative embodiment of the pole 112 formed from three telescoping sections 128, 130 and 132. A sleeve 134 engages the top section 132 once the pole 112 is extended to a desired height.

Figure 7:
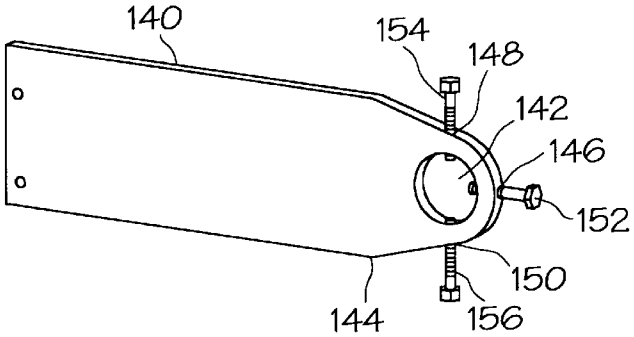
FIG. 7 is a detail view illustrating a baseball support plate.

FIG. 7 illustrates a baseball support arm 140 provided with an opening 142 formed in its distal end 144. The opening 142 is sized and shaped to receive a standard size baseball therein. The distal end 144 of the support arm 140 is formed with an opening 146 in alignment with a longitudinal axis of the support arm 140, and a pair of opposing openings 148 and 150 are formed along an axis transverse to the longitudinal axis of the support arm 140. The openings 146, 148 and 150 receive threaded bolts 152, 154 and 156, respectively, the threaded portion of the bolts being large enough to pass the corresponding opening and enter into the apertures formed in the baseball body when the ball is positioned in the opening 142. By tightening the position of the bolts 152, 154 and 156, the baseball can be removably secured in the support arm 140 and replaced, when worn or damaged.

Figure 8:
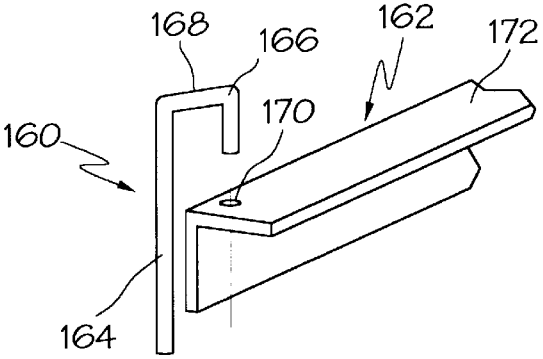
FIG. 8 is a detail exploded view illustrating an alternative embodiment of a spike structure.

FIG. 8 illustrates an alternative manner of securing spikes 160 with the base 162. The spike 160 is hook-shaped with an elongated first portion 164, a parallel portion 166 and a connecting portion 168. The portion 166 is adapted to pass through an opening 170 formed in a top plate 172 of the base 162. When the spike 160 is engaged with the plate 172, the transverse connecting portion 168 contacts the top surface 172, while at least a portion of the parallel arm 166 extends downwardly below the plate 172. As a result, the spike 160 is detachably engaged with the base 162, allowing to quickly connect/disconnect the spikes from the base and set up the baseball teaching apparatus in an efficient, easy manner.

Figure 9:
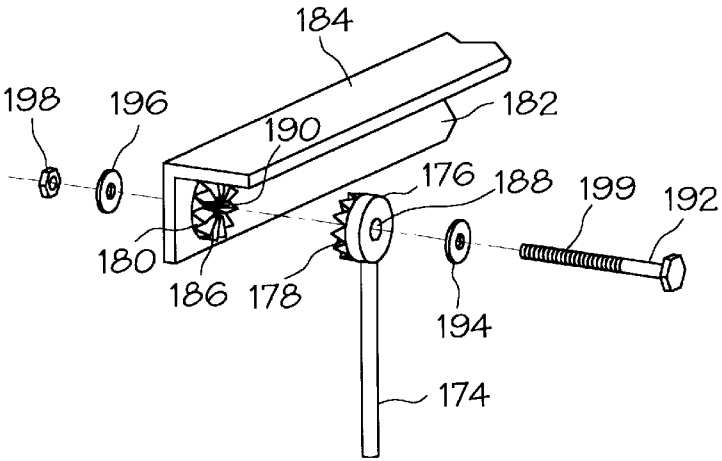
FIG. 9 is a detail view illustrating an alternative embodiment of connection of a spike with a base plate.

With reference to FIG. 9, another alternative embodiment of a spike attachment to the base is illustrated. In this embodiment, a spike 174 is provided with a plate 176 at its upper end. The plate 176 carries a plurality of outwardly extending teeth 178 spaced about the circumference of the plate 176. A similar plate 180, which is a mirror image of the plate 176 is secured to a vertical plate 182 of the base cross bar 184. The plate 180 is provided with outwardly extending teeth 186 that mesh with the teeth 178 when the plate 176 is in contact with the plate 180. The plate 176 is provided with a central opening 188, and the plate 180 is provided with a similar central opening 190. The openings 188 and 190 are adapted to received a threaded bolt 192 therethrough. The bolt 192 is long enough to extend through an optional washer 194, openings 188, 190 and an optional washer 196 positionable on an opposite side of the plate 182. A nut 198 engageable with the threads 199 of the bolt 192 ensures fixed engagement of the bolt 192 with the spike 174 and the base cross bar 184. During storage or transportation, the bolt 192 can be withdrawn from the engagement with the spike 174 and the base, allowing to disassemble the base in an easy manner.

Figure 10:
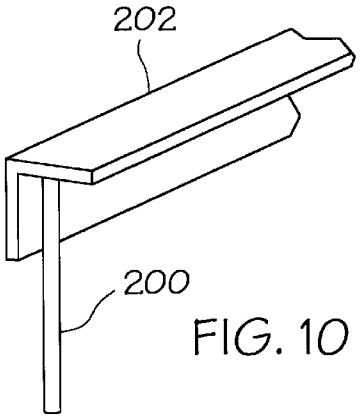
FIG. 10 is a detail view showing still another alternative embodiment of connecting a spike to the base.

FIG. 10 shows still another embodiment of the spikes-to-base attachment, wherein a spike 200 is permanently attached to the base 202 by welding or the like. It is envisioned that this embodiment will be particularly advantageous for locations where the baseball teaching apparatus 10 can be installed on a permanent basis and does not have to be relocated or stored away from the field for any considerable length of time.

Figure 11:
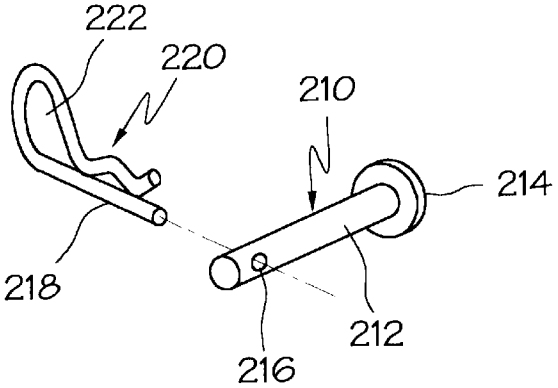
FIG. 11 is a detail view showing a clip and pin assembly alternatively used for securing the pole to the base, or adjusting position of the baseball support arm on the pole, or for securing the baseball support plate to a sleeve.

FIG. 11 illustrates a clip and pin assembly in more detail. As can be seen in the drawing, a pin 210 has a stem 212 that carries a head 214 on one of its ends. Adjacent the opposite end of the pin stem 212, there is a through opening 216 that is adapted to receive an arm 218 of a clip 220. When secured together, the stem 212 of the pin 210 will move into a loop opening 222 of the clip 220 and remain there, unless disconnected. The pin and clip assembly can be used for securing the pole to the base, as shown in FIG. 5, or on the support arm sleeve, as shown in FIG. 14 and described hereinafter, or for securing the baseball support arm to the support bracket, as shown in FIG. 6.

Figure 12:
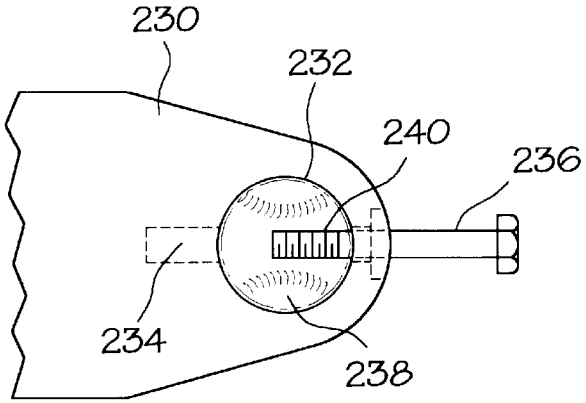
FIG. 12 is a detail view showing an alternative embodiment of securing a baseball to the baseball carrying plate.

FIG. 12 illustrates a detail of another embodiment of attachment of a baseball to the support arm. As can be seen in the drawing, the support arm 230 is provided with an opening 232 adjacent one of its ends. An opening 234 is formed in the body of the support arm 230, the opening 234 receiving a portion of a bolt 236 therein. A standard baseball 238 is inserted into the opening 232, the baseball 238 being provided with an aperture 240 extending into the body of the baseball. The aperture 240 is aligned with the opening 234 in the support arm 230, and a bolt 236 is inserted through the aperture 238 and the opening 234, securing the baseball in a detachable fixed position in relation to the support arm 230.

Figure 13:
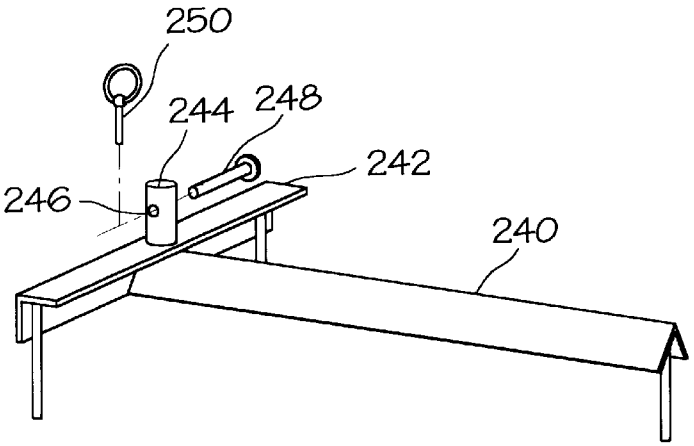
FIG. 13 is a detail exploded view showing an alternative embodiment of a base with a pole pin assembly.

FIG. 13 is a detail exploded view showing still another alternative embodiment of attachment of a pole to the base. The base, similarly to the embodiments of FIGS. 1–3, is provided with an elongated bar 240 and a cross bar 242. A pole pin 244 is attached to the horizontal top surface of the cross bar 242 and extends outwardly therefrom. An opening 246 extends through the pole pin 244, the opening being sized and shaped to receive a pin 248 therethrough. The pin 248 is formed with a through aperture which receives a key 250 when the pin 248 is inserted into an opening formed in an upright pole, the pin 244 exiting from the diametrically opposite end of the pole (not shown). By removing the key 250, the pin 248 can be withdrawn from the engagement with the pole and the pole pin 244, and the baseball teaching device disassembled for transportation or storage.

FIG. 14 shows a detail view of an alternative embodiment of the upright pole that is comprised of a pair of telescoping sections 260 and 262. The telescoping sections are secured by a bolt 264 to prevent their vertical movement in relation to each other when the pole is oriented in place. The upper section 262 is provided with a plurality of openings 266 that receive a pin 268 therethrough. A clip or a key 270 inserted into an aperture formed in the pin 268 secures a sleeve 272 in a desired vertical position along the pole section 262.

Many other changes and modifications can be made in the design of the present invention without departing from the spirit thereof. I, therefore, pray that my rights to the present invention be limited only by the scope of the appended claims.

I claim:

1. A baseball teaching apparatus, comprising:

a base mountable on a horizontal surface;

an upright pole detachably secured to the base and extending vertically upwardly therefrom; and a resilient baseball support arm detachably secured to said pole and extending at a substantially right angle thereto, said baseball support arm providing resistance to a striking force exerted on a baseball secured to a distal end of said baseball support arm, said baseball support arm comprising a flexible plate provided with a flexible resilient insert fitted into a body of said plate, said insert increasing resistance of the baseball support arm to the striking force.

2. A baseball teaching apparatus, comprising:

a base mountable on a horizontal surface;

an upright pole detachably secured to the base and extending vertically upwardly therefrom;

a resilient baseball support arm detachably secured to said pole and extending at substantially right angle thereto, said baseball support arm providing resistance to a striking force exerted on a baseball secured to a distal end of said baseball support arm, and a baseball bat supporting member, said supporting member comprising a slotted bar securely attached to said baseball support arm and extending at a generally right angle thereto.

3. A baseball teaching apparatus, comprising:

a base mountable on a horizontal surface;

an upright pole detachably secured to the base and extending vertically upwardly therefrom, said upright pole being provided with a plurality of vertically spaced-apart apertures extending transversely to a longitudinal axis of the pole;

a resilient baseball support arm detachably secured to said pole and extending at substantially right angle thereto, said baseball support arm providing resistance to a striking force exerted on a baseball secured to a distal end of said baseball support arm, said baseball support arm comprising a means for non-rotatably securing the baseball support arm to the pole, said means comprising a hollow sleeve positioned in a surrounding relationship over at least a portion of said pole, said sleeve having a transverse opening, and wherein a securing pin is inserted into said opening and into the aperture formed in the pole, said sleeve being provided with two open ends to allow positioning of the sleeve on said pole at alternative ends of the sleeve, so as to further facilitate a varied vertical positioning of the baseball support arm in relation to the horizontal surface.

4. A baseball teaching apparatus, comprising:

a base mountable on a horizontal surface, said base comprising a T-shaped frame provided with a plurality of spikes extending downwardly therefrom and allowing embedment of the spikes into the horizontal surface;

an upright pole detachably secured to the base and extending vertically upwardly therefrom, said pole being provided with a plurality of vertically spaced-apart apertures; and a resilient baseball support arm detachably secured to said pole and extending at a generally right angle thereto, said baseball support arm providing resistance to a striking force exerted on a baseball secured to a distal end of said baseball support arm, said baseball support arm comprising a flexible plate provided with a flexible resilient insert, said insert increasing resistance of the baseball support arm to the striking force.

5. The apparatus of claim 4, wherein said baseball support arm is adapted for vertical sliding movement in relation to said pole so as to allow positioning of the baseball support arm at a desired height in relation to the horizontal surface.

6. The apparatus of claim 4, wherein said baseball support arm further comprises a hollow sleeve positioned in a surrounding relationship over at least a portion of said pole, said sleeve having a transverse opening therethrough, and wherein a securing pin is inserted into said opening and into a selected aperture formed in said pole to allow positioning of the baseball support arm at a desired vertical height in relation to the horizontal surface.

7. The apparatus of claim 4, further comprising a baseball bat supporting member, said supporting member comprising a slotted bar securely attached to said baseball support arm opposite said flexible plate and extending at a substantially right angle in relation to said pole when the baseball support arm is secured on said pole.

8. A baseball teaching apparatus, comprising:

a base mountable on a horizontal surface;

an upright pole detachably secured to the base and extending vertically upwardly therefrom; and a resilient baseball support arm detachably secured to said pole and extending at a substantially right angle thereto, said baseball support arm comprising a flexible plate provided with a flexible resilient insert, said insert increasing resistance of the baseball support arm to the striking force, said baseball support arm being non-rotatably mounted in relation to said pole and being vertically slidable in relation thereto, so as to facilitate vertical adjustment of a position of the baseball support arm in relation to the horizontal surface.

9. A baseball teaching apparatus, comprising:

a base mountable on a horizontal surface;

an upright pole detachably secured to the base and extending vertically upwardly therefrom; and a resilient baseball support arm detachably secured to said pole and extending at a substantially right angle thereto, said baseball support arm comprising a flexible plate provided with a flexible resilient insert, said insert increasing resistance of the baseball support arm to the striking force, said base comprising a T-shaped member provided with a plurality of spikes extending downwardly from a bottom surface of the T-shaped member and adapted for embedment into the horizontal surface.

* * * * *